US006369499B1

(12) United States Patent
Skupien

(10) Patent No.: US 6,369,499 B1
(45) Date of Patent: Apr. 9, 2002

(54) ELECTRON GUN WITH IMPROVED CATHODE VENTING

(75) Inventor: Thomas A. Skupien, Frankfort, KY (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/433,369

(22) Filed: Nov. 3, 1999

(51) Int. Cl.[7] ..... H01J 29/48; H01J 29/84

(52) U.S. Cl. ..... 313/414; 313/409; 313/412; 313/446; 313/447; 313/451; 313/461

(58) Field of Search ..... 313/409, 411, 313/412, 414, 410, 461, 446, 447, 451

(56) References Cited

U.S. PATENT DOCUMENTS 4,193,016 A * 3/1980 Zeidler ..... 313/449
4,771,214 A * 9/1988 Takenaka et al. ..... 313/479
5,118,988 A * 6/1992 della Porta ..... 313/561
6,262,527 B1 * 7/2001 Van Zutphen et al. ..... 313/481

FOREIGN PATENT DOCUMENTS

JP 2001167695 * 6/2001 ..... H01J/7/18

* cited by examiner

*Primary Examiner*—Nimeshkumar D. Patel
*Assistant Examiner*—Sikha Roy
(74) *Attorney, Agent, or Firm*—Blakely, Sokoloff, Taylor & Zafman LLP

(57) ABSTRACT

Cathode venting for electron guns is improved by forming one or more vent holes around the apertures in the triode and any pre-focus lens. This configuration places the vent holes next to the active area of the cathode and provides a line of sight from the cathode to the funnel. If separate alignment holes are used to protect the aperture, one or more vent holes are provided in addition to the alignment holes. The pattern of vent and alignment holes is preferably rotationally symmetric about the aperture so that they do not effect the beam.

12 Claims, 3 Drawing Sheets

ELECTRON GUN WITH IMPROVED CATHODE VENTING

BACKGROUND OF THE INVENTION

1. Field of the Invention

This invention relates to electron guns and more specifically to an electron gun design that improves cathode venting thereby extending cathode life and improving performance.

2. Description of the Related Art

A CRT typically includes a neck glass that houses an electron gun, a funnel that is tapered to accommodate the deflection of the beam, and a target. The electron gun is comprised of two or more optical parts; the triode that forms the beam and one or more focusing lenses that focus the beam at the target. The funnel is coated with a reactive element, typically barium, to neutralize the poisonous byproducts that are out gassed by the triode's cathode element (and other parts of the CRT).

Electron guns are typically given a name that describes their focusing lenses. A standard bipotential gun has an anode voltage and a focus voltage that together define a single main focusing lens. As shown in FIG. 1, a standard Einzel gun 10 has a pre-focus lens 12 and two main lenses 14*a* and 14*b*.

The triode 16 is made up of the Emitter (cathode) 18, the Wehnelt suppressor electrode (biasing grid) 20 and the extractor electrode (first accelerator grid) 22. The heating of the cathode during operation causes the electrons to be emitted at the cathode surface 24. The electrons are then pushed back to the cathode surface by the suppressor electrode. But, the suppressor electrode has an optical aperture that allows an extraction voltage from the first accelerator to penetrate through the aperture 26 and strip electrons off of the cathode. This results in a converging electron beam that crosses over at an axial position somewhere between the biasing grid and the first accelerator, typically referred to as the "first crossover".

The biasing grid effectively forms an iris, which the beam passes through. This iris can be opened or closed by varying the voltage on the biasing grid. If the biasing voltage is brought closer to the cathode voltage then the cathode's active emitting surface becomes larger in diameter. This active area serves as the object in the total optical system. While this voltage change allows more current to escape from the cathode it increases the object size for the optical system. A smaller active area corresponds to a smaller spot size, provided that the cathode is healthy enough to emit the required peak current densities.

Increasing the extraction voltage on the first accelerating grid increases the biasing voltage required to "cutoff" the beam. This causes the active cathode surface to decrease in size but reduces the slope of the current vs. biasing voltage curve. This increase of the extraction voltage also increases the beam angle, which could be desirable or undesirable depending on the size of the main focusing lens.

This beam 27 is then sent through pre-focus lens 12 (volume between first accelerator electrode 22 and a second accelerator electrode 28), first main lens 14*a* (volume between second accelerator electrode 28 and a focus electrode 30) and second main lens 14*b* (volume between focus electrode 30 and a final accelerator electrode 32) that focus the beam at the target. The higher the potential difference between the electrodes the stronger the lensing effects. But, a stronger lens has more spherical aberration.

In an Einsel gun the second accelerator electrode and final accelerator electrode are both held at anode potential and the focus electrode is at a lower potential. Second accelerator electrode 28 is electrically connected to final accelerator electrode 32 via a jumper 34. Final accelerator electrode 32 is connected to an internal conductive coating 36 on the inside of a neck glass 38, which is held at anode potential, by a number of snubber springs 40. The diameter of the main lenses is limited to the space between a pair of mounting beads 42*a* and 42*b*. The smaller the main lenses 14*a* and 14*b* the greater the spherical aberration for a given beam size.

A large beam is desirable because it has a steeper crossover angle at the first crossover, which reduces the spot size at the target. But, as the beam increases in size the spherical aberration affects increase the spotsize. Thus, the Triode must be optimized for the best possible spotsize for a given focusing lens system.

Spot size and life are directly tied to the health of cathode 18 and more specifically active area 24. If the cathode becomes poisoned during activation or normal operation its ability to deliver high peak current densities, e.g. 5 microamps per square centimeter, will suffer and its lifetime will shorten. Thermal stimulation of the cathode produces free elements that emit the electrons and byproducts that, if not removed, will recombine with the free elements thereby poisoning the cathode.

In most electron guns, these byproducts are removed by venting them to a funnel 44 whose inner surface has a reactive coating 46 such as barium that neutralizes the byproducts. The vent is simply a path from the cathode's active area 24 to the reactive coating 46. In most guns, this path is the line of sight through the aperture holes 26 in the triode and pre-focus elements into the funnel 44. A straight or "line of sight" path is the most efficient. Each ninety-degree turn that must be traversed to reach the funnel reduces conduction by fifty percent.

Most guns use a fairly large aperture 26, on the order of 400 microns in diameter. In most cases, this is adequate to vent the cathode during normal operation. However, during cathode activation when the emission of byproducts is greatest the cathode is in danger of being poisoned. Furthermore, any attempt to reduce the aperture will choke off the vent capacity and poison the cathode. This will reduce the peak current density, which already needs to be higher if a smaller aperture is used.

More specifically, cathode 18 comprises a metallic base coated with a mixture of barium carbonate, strontium carbonate, calcium carbonate, and a nitro-cellulose binder. The cathode must be activated before it can efficiently emit electrons. This activation process is comprised of three basic steps. First, the cathode is brought to a temperature that will break down its nitro-cellulose binder. This causes compounds that are poisonous to the activated cathode to out gas and linger near cathode surface 24 unless sufficient venting is provided. The second step is to break down the three carbonates into their respective oxides by increasing the cathode temperature. This process causes more poisons to out gas and linger near the cathode. The final step is to partially break down the three oxides into free barium, strontium, and calcium respectively by again increasing the temperature of the cathode. Once, this third step is performed the cathode is subject to poisons permanently combining with the free barium, strontium and calcium. This irreversibly reduces the total amount of free barium, strontium, and calcium available and raises the work function of the cathode surface.

The cathode's emission current is subject to two limitations. First, the cathode has a temperature limited emission current density, which varies widely from cathode to cathode. Differences in the cathode's activation and the tube's vacuum quality can change the temperature limit of the current density. A cathode that was subjected to poisons during activation will have a lower temperature limited emission current density. Secondly, the cathode emission is subject to a space charge limitation at the surface of the cathode, which is determined by the physical geometry of the triode. Whichever limit is smaller prevails. Typically, the triodes are designed to operate in space charge limited conditions.

During normal operation, the cathode is heated to a temperature that normally ensures space charge limited conditions. If the cathode was not properly vented during activation then the typical operating temperature will be insufficient. The operating temperature kept as low as possible in order to minimize barium, strontium, and calcium evaporation during the life of the cathode. It is considered poor practice to increase the cathode temperature to compensate for a poorly activated cathode. This problem is exacerbated at higher and higher resolutions, which require smaller apertures and higher peak current densities.

As shown in FIG. 2, a pair of small alignment holes 50*a* and 50*b* are formed on either side of aperture 26 in the suppressor electrode 52 and each of the triode and pre-focusing lens grid parts. Typically, the grid parts are aligned by inserting a pin through their apertures 26. Once mounted the pin is removed. However, the alignment pin may damage the apertures in the process.

AEG forms the pair of small alignment holes 50*a* and 50*b* on either side of the aperture 26 so that pins can be inserted to align the gun and then removed without damaging the aperture. The alignment holes 50*a* and 50*b* are small and set toward the outside of suppressor electrode 52 and away from the cathode's active area 24 to improve structural integrity. Thus their contribution to venting is minimal. Furthermore, the alignment holes are not rotationally symmetric about aperture 26 and thus may introduce astigmatism into the beam, which is another reason for setting them toward the outside of the suppressor electrode 52.

FIG. 3 shows another modification in which side vent holes 60 are formed in the suppressor electrode 62. Because side vent holes 60 are not proximate the cathode's active area 24 and do not have a line of sight to the funnel they basically provide minimal vent capacity. Side getters are sometimes used to coat the neck glass but are very inefficient due to their limited surface area and thus rarely used.

In each of these cases, the inability to remove the byproducts tends to poison the cathode thereby reducing its ability to deliver high peak current densities necessary for small spot sizes and reducing the cathode lifetime. As the aperture diameter is reduced in order to get smaller spot sizes for higher resolution guns, the aperture chokes off the vent capacity. During normal operation, the known gun configurations are probably adequate to pump out and neutralize these byproducts. However, during cathode activation the nitro-cellulose binder is released and the triple carbonate bonds are broken, which causes a large spike in poisonous by products to be produced. The current configurations are wholly inadequate to remove the byproducts and protect the cathode during activation. As a result, smaller aperture electron guns are impractical.

SUMMARY OF THE INVENTION

In view of the above problems, the present invention provides a reduced aperture electron gun with improved cathode venting.

This is accomplished by forming one or more vent holes around the apertures in the triode and any pre-focus lens. This configuration places the vent holes next to the active area of the cathode and provides a line of sight from the cathode to the funnel. The poisonous byproducts travel through the vent holes along the line of sight into the funnel where they are collected and neutralized by the reactive coating. Each hole is typically at least five times the diameter of the aperture to provide sufficient vent capacity without sacrificing structural integrity. If separate alignment holes are used to protect the aperture, one or more vent holes are provided in addition to the alignment holes. The pattern of vent and alignment holes is preferably rotationally symmetric about the aperture so that they do not effect the beam. This effectively separates the electron aperture and vent aperture functions between the aperture and the vent holes, respectively, while maintaining the line of sight to the funnel.

These and other features and advantages of the invention will be apparent to those skilled in the art from the following detailed description of preferred embodiments, taken together with the accompanying drawings, in which:

DETAILED DESCRIPTION OF THE INVENTION

Standard electron guns have a fundamental design limitation that hinder their ability to achieve smaller spot sizes, hence higher resolutions. Current gun designs rely on the aperture holes to both form the beam and vent the poisonous byproducts from the cathode to the funnel. However, to achieve smaller spot sizes the aperture should be made both smaller to achieve a smaller spot size and larger to provide greater vent capacity, which is not possible.

The present invention separates the electron aperturing and venting functions by forming one or more vent holes around the aperture holes. As a result, the aperture can be made smaller thereby forming a larger beam and a smaller spot size. Each vent hole can be at least five times the diameter of the aperture hole without sacrificing structural integrity of the grid parts. This greatly enhances venting, which results in a healthier cathode that can produce higher peak current densities over a longer lifetime.

Figure 1:
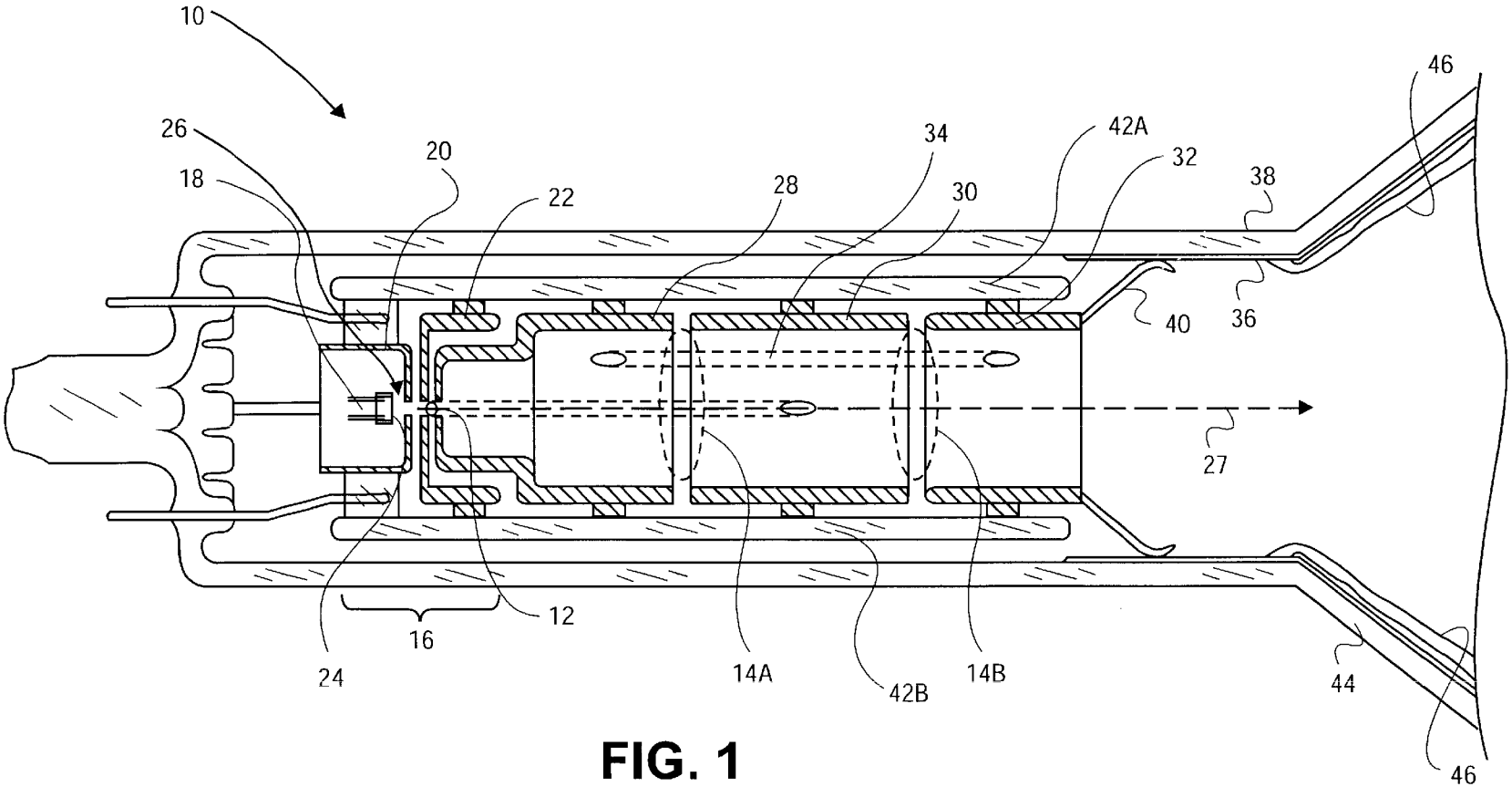
FIG. 1 (PRIOR ART)
FIG. 1, as described above, is a section view of an Einsel gun.
Figure 5A:
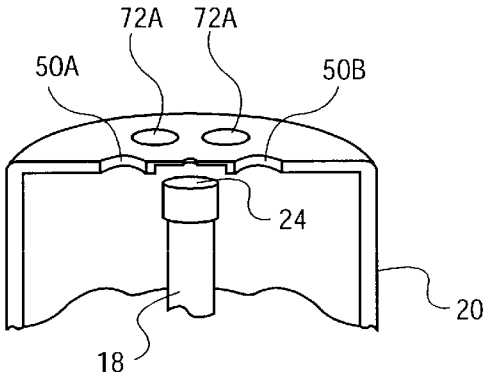
FIGS. 5*a* and 5*b* are a section view and end view of the cathode and suppressor electrode in accordance with the present invention.
Figure 2:
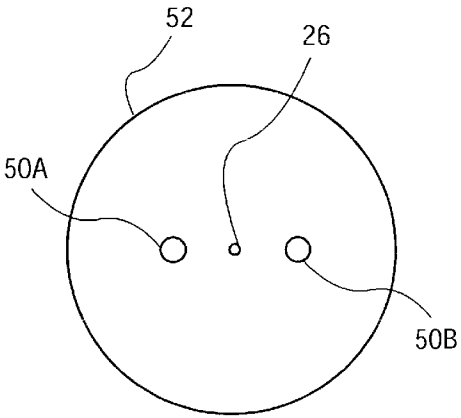
FIG. 2 (PRIOR ART)
FIG. 2, as described above, is a view of a suppressor grid having separate aperture and alignment holes.
Figure 3:
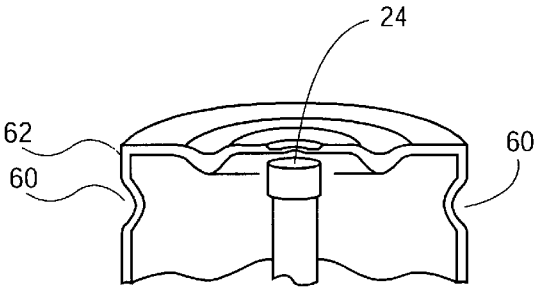
FIG. 3 (PRIOR ART)
FIG. 3, as described above, is a more detailed section view of the cathode and suppressor electrode.
Figure 5B:
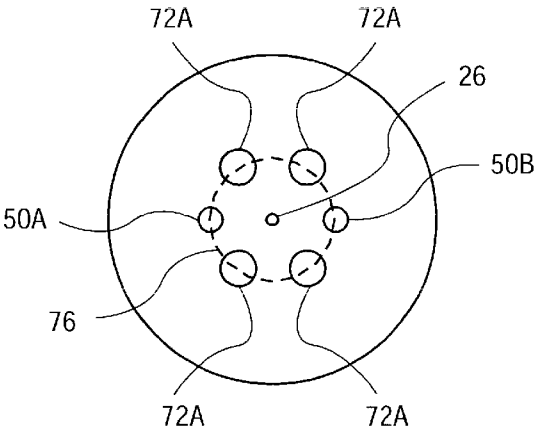
Figure 4:
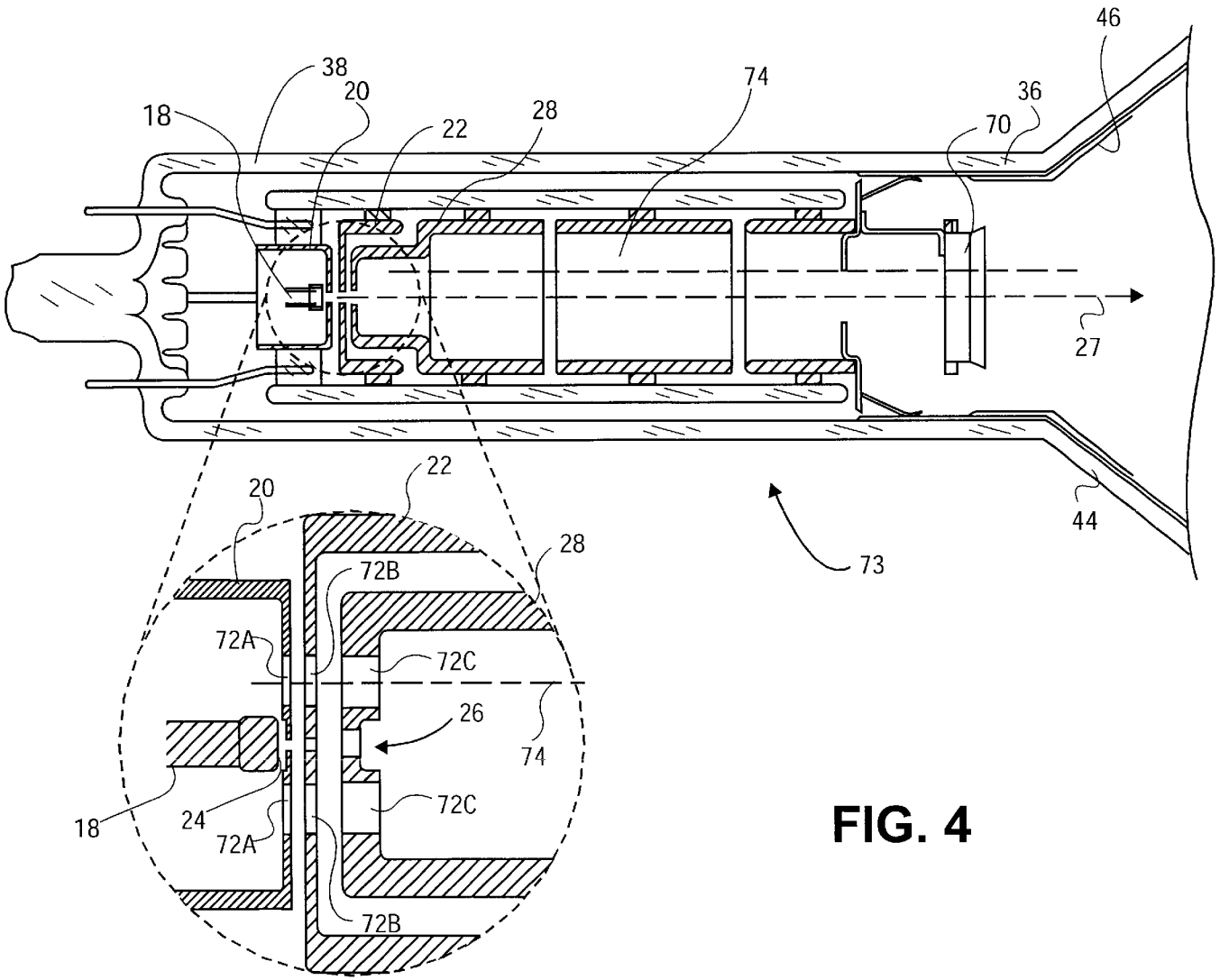
FIG. 4 is a section view of an Einsel gun and partially exploded view of the triode region in accordance with the present invention.

As shown in FIGS. 4 and 5*a–b*, the standard Einzel gun 10 depicted in FIG. 1 has been modified to incorporate vent holes for improving cathode venting. Although the invention is depicted and described in conjunction with the Einzel gun, the invention is generally applicable to other electron guns such as the bi-potential. For clarity, the same numbers used in FIGS. 1 and 2 will be used for like parts in FIGS. 4 and 5–*b*. The gun is shown with a standard getter 70 that flashes the reactive coating 46.

As best shown in the partially exploded portion of FIG. 4, vent holes 72*a*, 72*b* and 72*c* are formed in suppressor electrode 20, extractor electrode 22 and second accelerator electrode 28, respectively, of gun 73. In general, vent holes would be formed in all of the triode electrodes and the pre-focus electrode in order to expose the cathode to the funnel region. The vent holes provide a line of sight path 74 from just adjacent the cathode's active area 24 through the main lens 14*a* and 14*b* and into funnel 44 and its reactive coating 46. The byproducts that are out gassed from cathode 18 flow along this path to funnel 44 where they react with reactive coating 46 and are neutralized.

As best shown in FIG. 5*b*, this particular configuration includes alignment holes 50*a* and 50*b*, which have been moved closer to aperture 26. The alignment holes are typically three times bigger than a standard aperture. Four vent holes 72*a* are formed in suppressor electrode 20 around aperture 26. The vent and alignment holes are preferably arranged in a rotationally symmetric pattern 76 about aperture 26 in order to avoid disturbing the beam.

Although the addition of vent holes 72–72*c* should reduce cathode poisoning in any gun configuration, the addition is particularly appropriate in high-resolution guns where the diameter of aperture 26 is reduced, even smaller than is possible with current designs. In a high-resolution gun, the vent holes will be typically at least five times the diameter of the aperture. In these high-resolution designs, the vent capacity provided by the aperture alone is not sufficient to transport the poisonous byproducts away from the cathode and into the funnel. Thus, without the additional vent holes the cathode would be irreversibly poisoned during activation.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A CRT, comprising:

a neck;

a funnel having an internal reactive coating;

a target; and an electron gun in the neck including a triode that forms an electron beam and a focusing lens that focuses the electron beam onto the target, the triode including a cathode having an active area that when heated emits electrons and other byproducts, a suppressor electrode with an aperture that acts as an iris to control the size of the cathode's active area, and an extractor electrode with an aperture for extracting the emitted electrons through the iris to form the electron beam, the suppressor electrode and the extractor electrode each having at least one vent hole adjacent their respective apertures, the vent holes being aligned to provide a line of sight from the cathode through the main lens to expose the funnel so that the byproducts can travel from the cathode through the vent holes along the line of sight to the funnel where they are neutralized by the reactive coating.

2. The CRT of claim 1, wherein the suppressor electrode and the extractor electrode each comprises a plurality of the vent holes that are arranged in pattern that is rotationally symmetric about their respective apertures.

3. The CRT of claim 1, wherein each of the vent holes is at least five times the diameter of the aperture.

4. The CRT of claim 1, wherein the suppressor electrode and the extractor electrode further comprise a pair of alignment holes that are spaced on either side of their respective apertures.

5. The CRT of claim 1, wherein the suppressor electrode's and the extractor electrode's respective apertures are of a size that would be too small to adequately vent the byproducts from the cathode to the funnel in the absence of the vent holes.

6. A CRT, comprising:

a neck;

a funnel having an internal reactive coating;

a target; and an electron gun in the neck including a triode that forms an electron beam and a focusing lens that focuses the electron beam onto the target, the triode including a cathode having an active area that when heated emits electrons and other byproducts, a suppressor electrode with an aperture that acts as an iris to control the size of the cathode's active area, and an extractor electrode with an aperture for extracting the emitted electrons through the iris to form the electron beam, the suppressor electrode and the extractor electrode each having a plurality of vent holes that are arranged in a rotationally symmetric pattern around their respective apertures, the vent holes being aligned to provide a line of sight from the cathode through the main lens to expose the funnel so that the byproducts can travel from the cathode through the vent holes along the line of sight to the funnel where they are neutralized by the reactive coating.

7. The CRT of claim 6, wherein each of the vent holes is at least five times the diameter of the aperture.

8. The CRT of claim 6, wherein the suppressor electrode and the extractor electrode further comprise a pair of alignment holes that are spaced on either side of their respective apertures.

9. A CRT, comprising:

a neck;

a funnel having an internal reactive coating;

a target; and an electron gun in the neck including a triode that forms an electron beam and a focusing lens that focuses the electron beam onto the target, the triode including a cathode having an active area that when heated emits electrons and other byproducts, a suppressor electrode with an aperture that acts as an iris to control the size of the cathode's active area, and an extractor electrode with an aperture for extracting the emitted electrons through the iris to form the electron beam, the electron gun having a vent capacity that is required to adequately vent the byproducts from the cathode to the funnel during cathode activation, the suppressor electrode's and the extractor electrode's respective apertures having a size that is too small to provide the required vent capacity, the suppressor electrode and the extractor electrode each having at least one vent hole adjacent their respective apertures, the vent holes being aligned to provide a line of sight from the cathode through the main lens to expose the funnel with the required vent capacity so that the byproducts can travel from the cathode through the vent holes along the line of sight to the funnel where they are neutralized by the reactive coating.

10. The CRT of claim 9, wherein the suppressor electrode and the extractor electrode each comprises a plurality of the vent holes that are arranged in pattern that is rotationally symmetric about their respective apertures.

11. The CRT of claim 9, wherein each of the vent holes is at least five times the diameter of the aperture.

12. The CRT of claim 9, wherein the suppressor electrode and the extractor electrode further comprise a pair of alignment holes that are spaced on either side of their respective apertures.

* * * * *